US009972921B2

(12) United States Patent
Matsui et al.

(10) Patent No.: US 9,972,921 B2
(45) Date of Patent: May 15, 2018

(54) CONNECTOR WITH SUB-HOUSING AND UNITING PORTION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Masaaki Tabata, Mie (JP); Yasuo Omori, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days. days.

(21) Appl. No.: 15/512,975

(22) PCT Filed: Sep. 24, 2015

(86) PCT No.: PCT/JP2015/076868
§ 371 (c)(1),
(2) Date: Mar. 21, 2017

(87) PCT Pub. No.: WO2016/059947
PCT Pub. Date: Apr. 21, 2016

(65) Prior Publication Data

US 2017/0294722 A1 Oct. 12, 2017

(30) Foreign Application Priority Data

Oct. 15, 2014 (JP) ..... 2014-210489

(51) Int. Cl.
*H01R 13/629* (2006.01)
*H01R 13/502* (2006.01)
(Continued)

(52) U.S. Cl.
CPC ..... *H01R 4/2454* (2013.01); *H01R 4/184* (2013.01); *H01R 13/5045* (2013.01);
(Continued)

(58) Field of Classification Search
CPC ..... H01R 13/62911; H01R 13/62905; H01R 13/5045; H01R 13/4362; H01R 13/4361
(Continued)

(56) References Cited

U.S. PATENT DOCUMENTS

| | | | | |
|---|---|---|---|---|
| 6,527,583 | B2 * | 3/2003 | Plate | H01R 13/4362 439/157 |
| 2010/0240256 | A1 | 9/2010 | Bailey et al. | |
| 2016/0013575 | A1 * | 1/2016 | Campbell | H01R 13/4362 439/752 |

FOREIGN PATENT DOCUMENTS

| | | |
|---|---|---|
| JP | 5-24137 | 6/1993 |
| JP | 10-106670 | 4/1998 |
| JP | 4970595 | 4/2012 |

OTHER PUBLICATIONS

International Search Report dated Nov. 17, 2015.

* cited by examiner

*Primary Examiner* — Renee Luebke
*Assistant Examiner* — Paul Baillargeon
(74) *Attorney, Agent, or Firm* — Gerald E. Hespos; Michael J. Porco; Matthew T. Hespos

(57) ABSTRACT

It is aimed to provide a connector capable of dealing with a change in the number of poles without structurally changing a mating connector. Housings (11) for accommodating terminal fittings (12) electrically connectable to tab-like ter-
(Continued)

minals (52) include a main housing (11M) having a locking structure (21) for locking a mating connector (52) and a plurality of types of sub-housings (11S) having different number of poles and selectively unitable with the main housing (11M). The main housing (11M) and the sub-housing (11S) are united by coupling side surfaces to each other. A tab insertion groove (25) into which the tab-like terminal (52) is to be inserted at the time of connection to the mating connector is formed in a coupling part of the united housings (11).

4 Claims, 17 Drawing Sheets

(51) Int. Cl.
*H01R 4/24* (2018.01)
*H01R 4/18* (2006.01)
*H01R 13/504* (2006.01)

(52) U.S. Cl.
CPC . *H01R 13/62905* (2013.01); *H01R 13/62911* (2013.01); *H01R 2201/26* (2013.01)

(58) Field of Classification Search
USPC ..... 439/731, 696, 687, 598, 752, 177, 218
See application file for complete search history.

CONNECTOR WITH SUB-HOUSING AND UNITING PORTION

BACKGROUND

1. Field of the Invention

The invention relates to a connector.

2. Description of the Related Art

Plural different circuits often are connected via one connector, for example, in wiring harnesses of automotive vehicles. Japanese Unexamined Patent Publication No. H10-106670 discloses a connector that can facilitate a connecting operation by dividing a housing for each circuit. Each housing of this connector has a lock to be engaged with a lock receiving portion of a mating connector. In this way, the lock receiving portion of the mating connector is shared by the divided housings, making a structural change of the mating connector unnecessary.

Circuits to be connected to one connector differ depending on vehicle types, grades and the like in many cases and, for a change in the number of poles along. Thus, a plurality of types of housings having different numbers of poles need to be prepared. If a mating connector is configured such that a locking structure is changed in accordance with the size of a housing or tab-like terminals are projecting, it is necessary to make structural changes such as the omission of the tab-like terminals to prevent the tab-like terminals from butting against a united part of the housings.

The present invention was completed based on the above situation and aims to provide a connector capable of dealing with a change in the number of poles without structurally changing a mating connector.

SUMMARY

The invention is directed to a connector with housings for accommodating terminal fittings electrically connectable to tab-like terminals. The housings including a main housing having a locking structure for locking a mating connector and a plurality of types of sub-housings having different number of poles and selectively unitable with the main housing. The main housing and the sub-housing are united by coupling side surfaces to each other. A tab insertion groove is formed in a coupling part of the united housings, and the tab-like terminal is inserted into the tab insertion groove at the time of connection to the mating connector.

According to the invention, the number of poles of the connector can be changed by uniting the sub-housing appropriately selected from the plurality of types of sub-housings with the main housing. Further, the locking structure is provided on the main housing instead of on the sub-housings that are to be appropriately changed. Thus, a locking structure of the mating connector need not be changed. Furthermore, since the tab-like terminal is inserted into the tab insertion groove, changes of the mating connector such as the omission of the tab-like terminal need not be made. Therefore, a change in the number of poles can be dealt with without structurally changing the mating connector.

A retainer may be mounted into each of the main housing and the sub-housing for locking and retaining the accommodated terminal fittings, and positioning structures may be provided on side surfaces of the retainers for effecting positioning by being fit to each other when the housings are united. According to this configuration, the retainers can be positioned and united in the housings.

Coupling structures may be provided on the side surfaces of the main housing, and the sub-housing may be coupled to each other by being pushed in facing directions of the side surface of the main housing and the side surface of the sub-housing. The positioning structures may be configured such that a positioning projection is fit into a positioning recess closed over the entire periphery. According to this configuration, the retainers can be positioned and united on four sides in the housings.

DETAILED DESCRIPTION

Hereinafter, one specific embodiment of the present invention is described in detail with reference to FIGS. 1 to 18.

Figure 2:
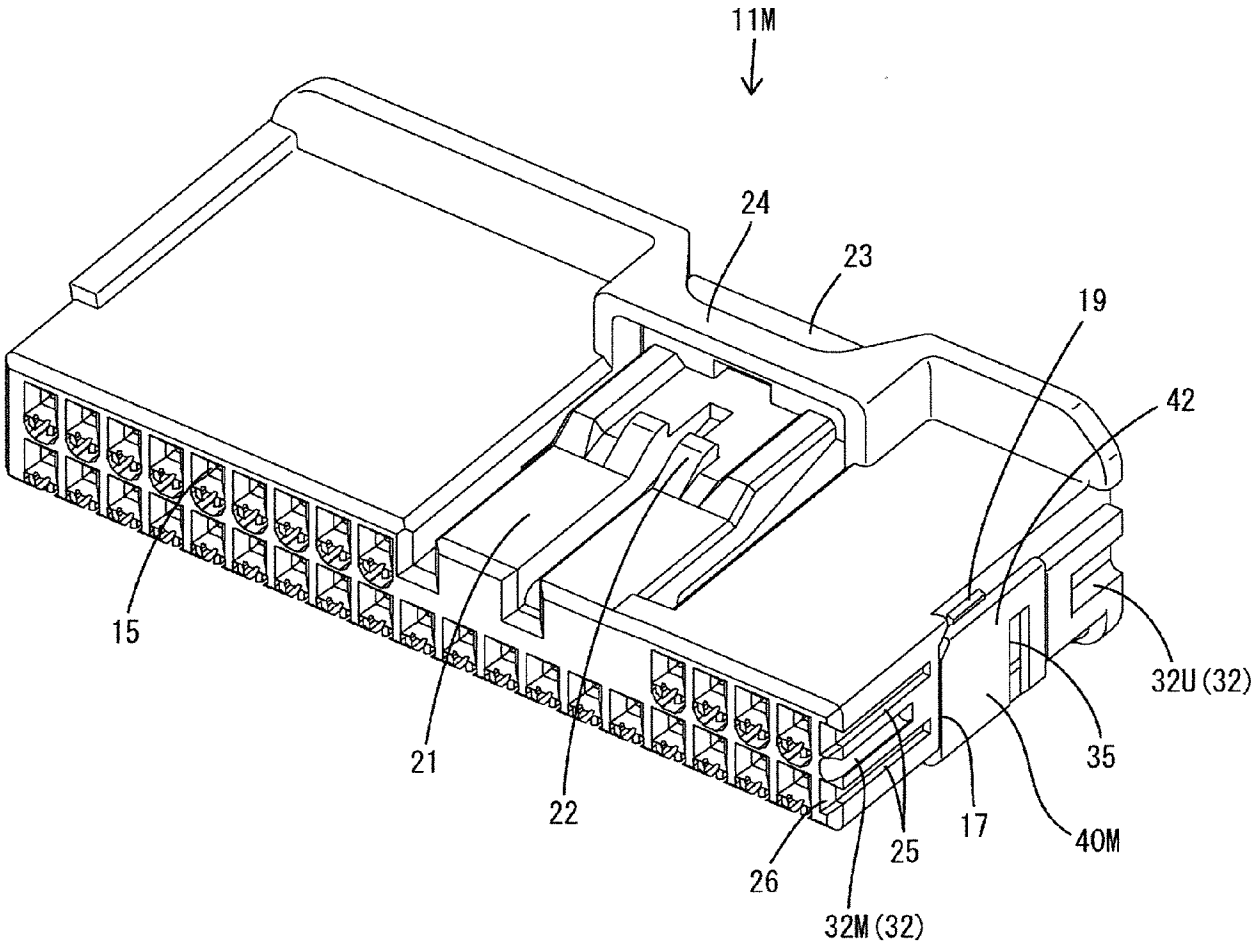
FIG. 2 is a perspective view showing a main housing.

A connector 10 in this embodiment is connected to a mating connector 50 with projecting tab-like terminals 62. The mating connector 50 is a board connector to be fixed on a printed board P, and the connector 10 is connected to ends of wires W arranged in an automotive vehicle (not shown). The wires W and the print board P are connected electrically by connecting the connectors 10. In the following description, connection surfaces of the connectors 10, 50 are referred to as the fronts and an upper side (side where a lock arm 21 is formed) and a lower side of FIG. 2 are referred to as an upper side and a lower side in each constituent member.

Figure 1:
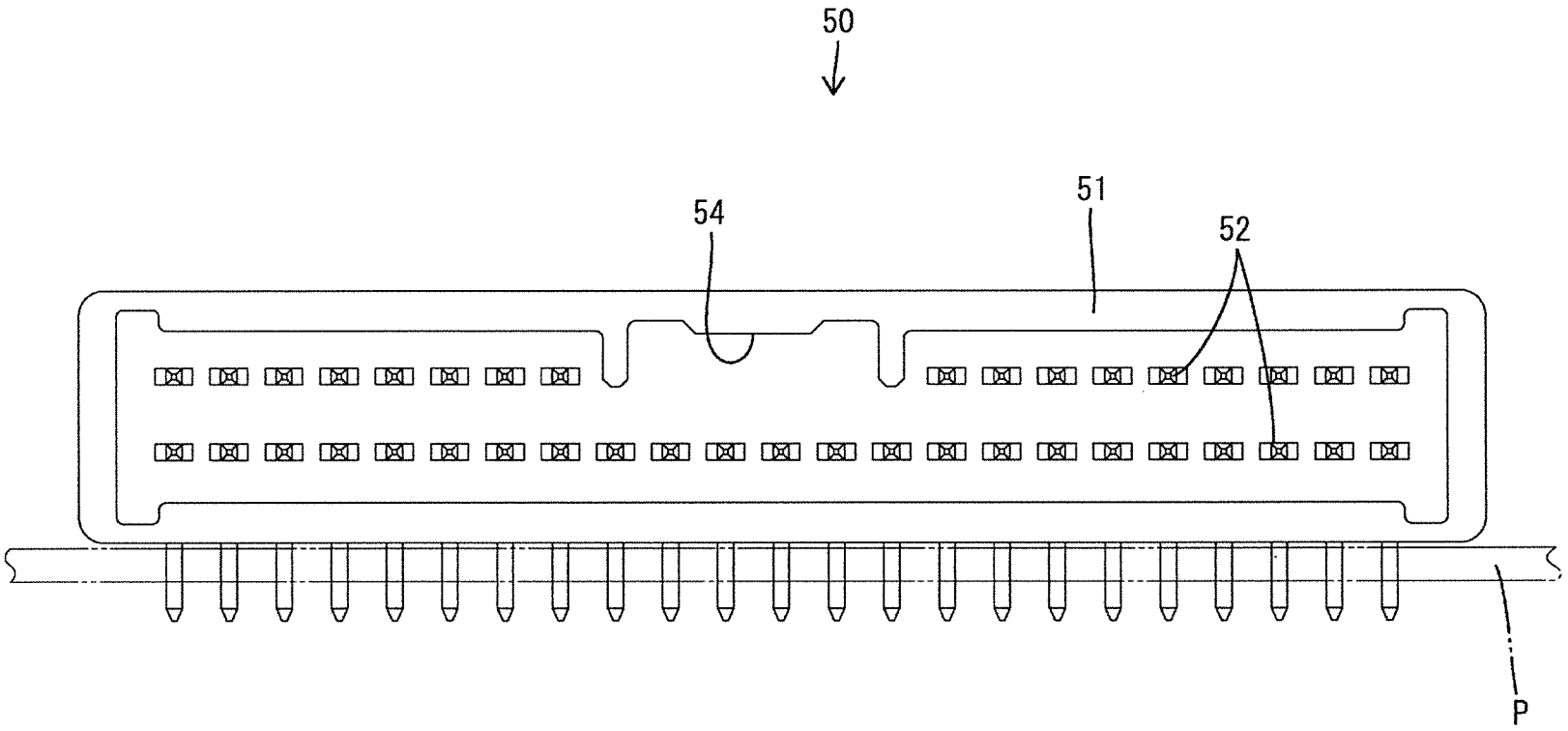
FIG. 1 is a front view showing a mating connector in an embodiment.

As shown in FIG. 1, the mating connector 50 includes a receptacle 51 open forward, and a plurality of the tab-like terminals 52 project on a back wall of the receptacle 51. The mating connector 50 has 40 poles in this embodiment. The tab-like terminals 52 are arranged side by side in a lateral direction in upper and lower stages and are at equal intervals in the lateral direction in each stage. Further, the tab-like terminals 52 in the upper stage and those in the lower stage are aligned without deviating in the lateral direction.

Figure 11:
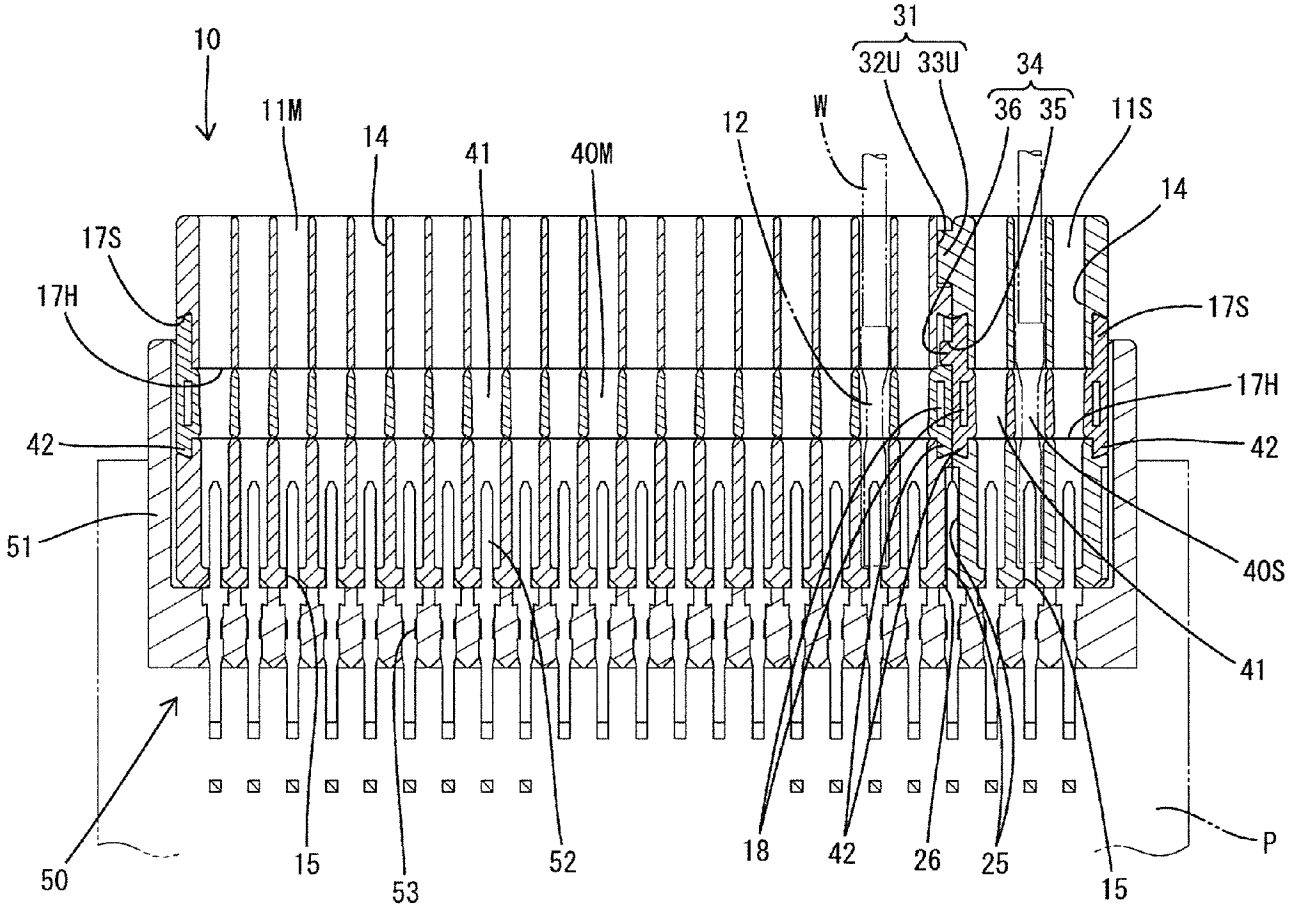
FIG. 11 is a section, corresponding to a cross-section at a position C-C of FIG. 10, showing a state where the united main housing and first sub-housing are connected to the mating connector.

The tab-like terminal 52 is fixed by being press-fit into a terminal press-fit hole 53 that penetrates through the back wall of the receptacle 51 (see FIG. 11). A rear end side of the tab-like terminal 52 is bent down behind the back wall and electrically connected to a terminal portion on the print board P.

The mating connector 50 has a lock receiving portion 54 to which the lock arm 21 of the connector 10 is lockable. The lock receiving portion 54 projects down on an upper side of an inner peripheral surface of the receptacle 51. The lock receiving portion 54 is at a position slightly closer to one end side (closer to a left side of FIG. 1 in this embodiment) than a center of the mating connector 50 in the lateral direction. The tab-like terminals 52 are arranged only in the lower stage in a part where the lock receiving portion 54 is formed.

The connector 10 includes housings 11 for accommodating terminal fittings 12 electrically connectable to the tab-like terminals 52. The terminal fitting 12 includes a terminal body 13 into which the tab-like terminal 52 is inserted to be electrically connected, and is fixed to an end part of the wire W. The terminal body 13 is in the form of a rectangular tube and retained by having an intermediate part in a front-rear direction primarily locked by a locking lance 16 provided in a cavity 14. Further, the rear end of the terminal body 13 is locked secondarily from behind by a retainer 40, to be described later, so that the terminal fitting 12 is retained doubly.

The housing 11 is made of synthetic resin and internally has of cavities 14 for accommodating the terminal fittings 12. The cavities 14 are provided in upper and lower stages to correspond to the tab-like terminals 52 of the mating connector 50 and are arranged substantially at equal intervals in the lateral direction in each stage. A tab insertion hole 15 through which the tab-like terminal 52 is inserted penetrates through a front wall of each cavity 14. Each cavity 14 has the locking lance 16 for holding the terminal fitting 12 in a retained state by locking the terminal fitting 12 at a proper insertion position.

The retainer 40 is mounted in the housing 11 for locking and retaining the terminal fittings 12 accommodated at the proper insertion positions of the cavities 14. The retainer 40 includes a retainer body 41 shaped to be long in the lateral direction over the entire width of the housing 11 and side walls 42 provided on opposite lateral end parts of the retainer body 41.

Figure 6:
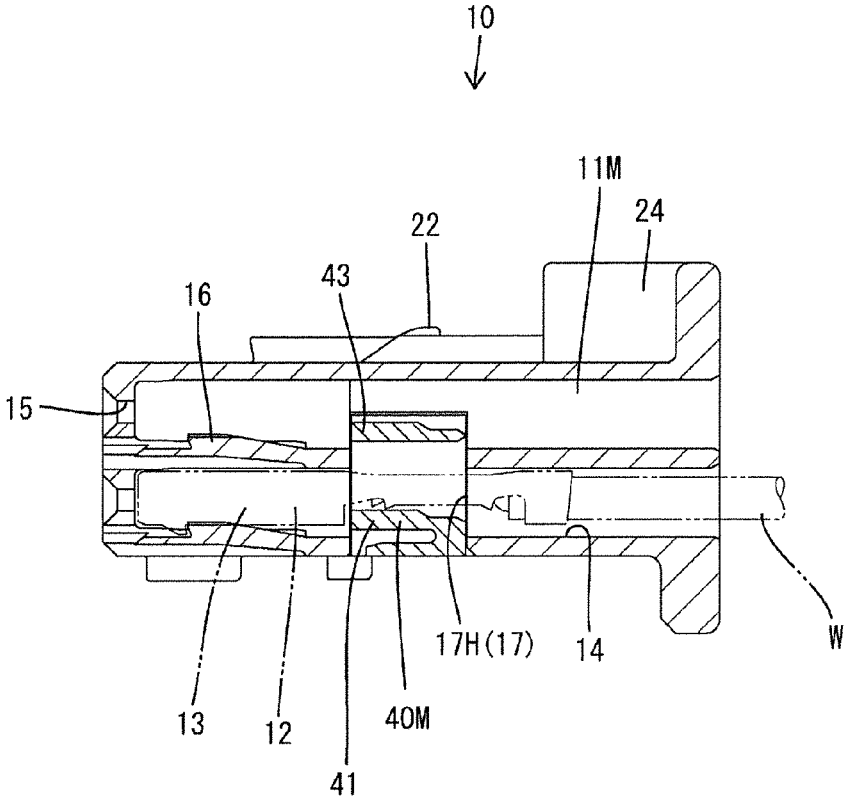
FIG. 6 is a section, corresponding to a cross-section at a position B-B of FIG. 5, showing the main housing in the state where the main retainer is assembled.

The retainer body 41 is provided with retaining portions 43 capable of locking the terminal fittings 12 at positions corresponding to the respective cavities 14 (see FIG. 6). The retainer 40 is movable between a partial locking position where the retaining portions 43 are retracted from the cavities 14 to allow insertion and withdrawal of the terminal fittings 12 and a full locking position where the retaining portions 43 project into the cavities 14 to lock the terminal fittings 12.

A locking claw projects in on an upper end part of the side wall 42 to be locked to a partial lock receiving portion 18 or a full lock receiving portion 19 on the housing 11 when the retainer 40 is arranged at the partial locking position or the full locking position.

The housing 11 is provided with a retainer mounting portion 17 into which the retainer 40 is to be mounted. The retainer mounting portion 17 includes a body accommodating portion 17H into which the retainer body 41 is to be accommodated and side wall accommodating portions 17S into which the side walls 42 are to be accommodated. The body accommodating portion 17H collectively communicates with all the cavities 14 and is open on the lower and both left and right side surfaces of the housing 11. Each side wall accommodating portion 17S is formed by recessing the side surface of the housing 11 in a range extending upward, forward and rearward from an opening in a side surface of the body accommodating portion 17H (see FIG. 3). The partial lock receiving portion 18 and the full lock receiving portion 19 project out in the side wall accommodating portion 17S.

The housings 11 include a main housing 11M including a locking structure for locking the mating connector 50 and a plurality of types of sub-housings 11S selectively unitable with the main housing 11M and having different numbers of poles.

The main housing 11M has the most poles (32 poles in this embodiment) among the housings 11 including the plural types of sub-housings 11S and is in the form of a flat block having a substantially rectangular cross-section long in the lateral direction.

The main housing 11M includes the lock arm 21 that is lockable to the lock receiving portion 54 of the mating connector 50. The lock arm 21 is provided on an upper surface side of the main housing 11M and the cavities 14 are formed only in the lower stage in a part where the lock arm 21 is formed. The lock arm 21 is cantilevered rearward with a front end serving as a base and is resiliently deflectable in a vertical direction. A lock protrusion 22 projects up substantially in a center of the lock arm 21 in the front-rear direction and an unlocking portion 23 is provide on the rear end of the lock arm 21 for disengaging the lock receiving portion 54 and the lock protrusion 22 by pushing down the lock arm 21. A protection wall 24 is provided around the unlocking portion 23 for preventing an erroneous operation of the unlocking portion 23.

The lock arm 21 is at a position near one end (near a right side in FIG. 2) in a width direction. When being fit into the mating connector 50, the main housing 11M is accommodated in one side (right side in FIG. 1) in the width direction of the mating connector 50 almost without any clearance. A connection space is left on the other side (left side in FIG. 1) of the mating connector 50, and the sub-housing 11S can fit therein.

The sub-housings 11S include a six-pole first sub-housing 11S with six cavities 14, a four-pole type second sub-housing 11S with four cavities 14 and a two-pole type third sub-housing 11S with two cavities 14.

The cavities 14 of the sub-housing 11S are aligned respectively with the cavities 14 of the main housing 11M in the lateral direction when the sub-housing 115 is united with the main housing 11M. The cavities 14 of the sub-housings 11 are at the same intervals as the cavities 14 of the main housing 11M.

The main housing 11M and the sub-housing 11S are united by coupling side surfaces to each other.

The side surfaces of the main housing 11M and the sub-housing 11S are provided with coupling structures 31 to be coupled to each other by being pushed in the lateral direction (facing directions of the side surfaces of the housing 11). The coupling structures 31 are coupled to each other by fitting coupling projections 33 projecting on the side surface of the sub-housing 11S into coupling recesses 32 formed by recessing the side surface of the main housing 11M. The coupling structures 31 are provided on front and rear end parts of the housing 11 (at front and rear sides of the retainer 40) and are long in the front-rear direction (see FIGS. 3 and 8).

Figure 3:
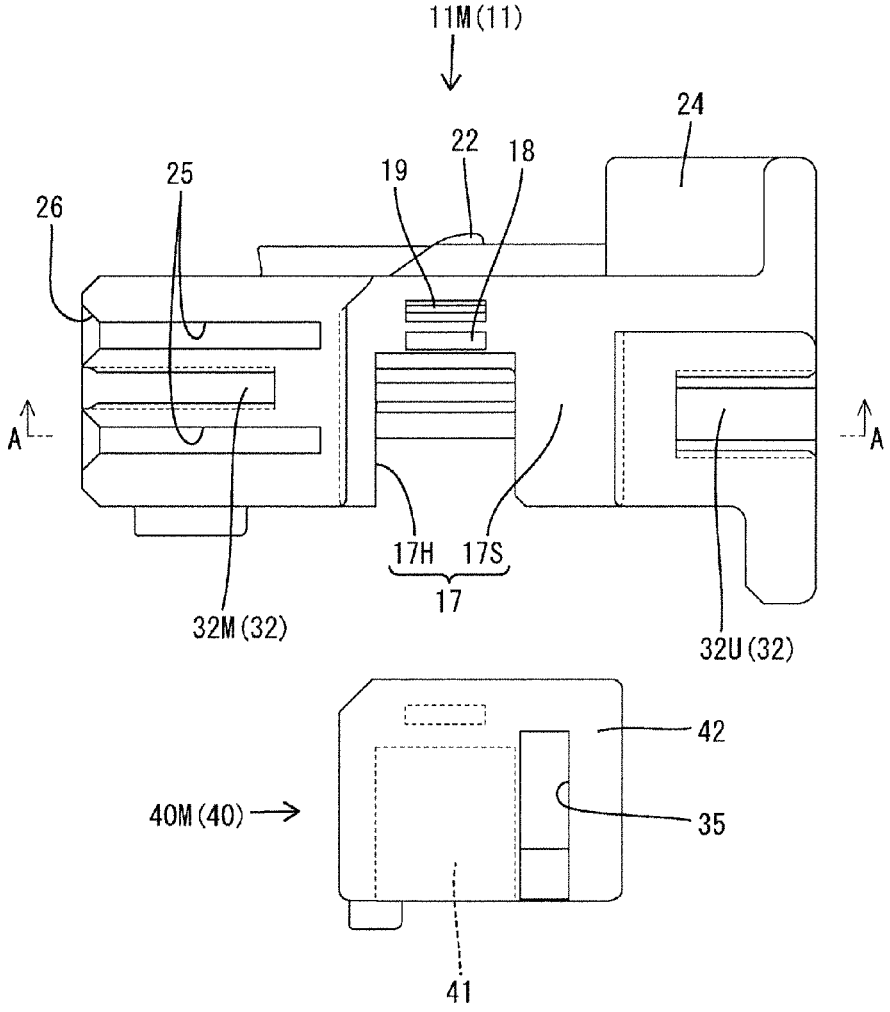
FIG. 3 is a side view showing a state where a main retainer is being assembled with the main housing.
Figure 4:
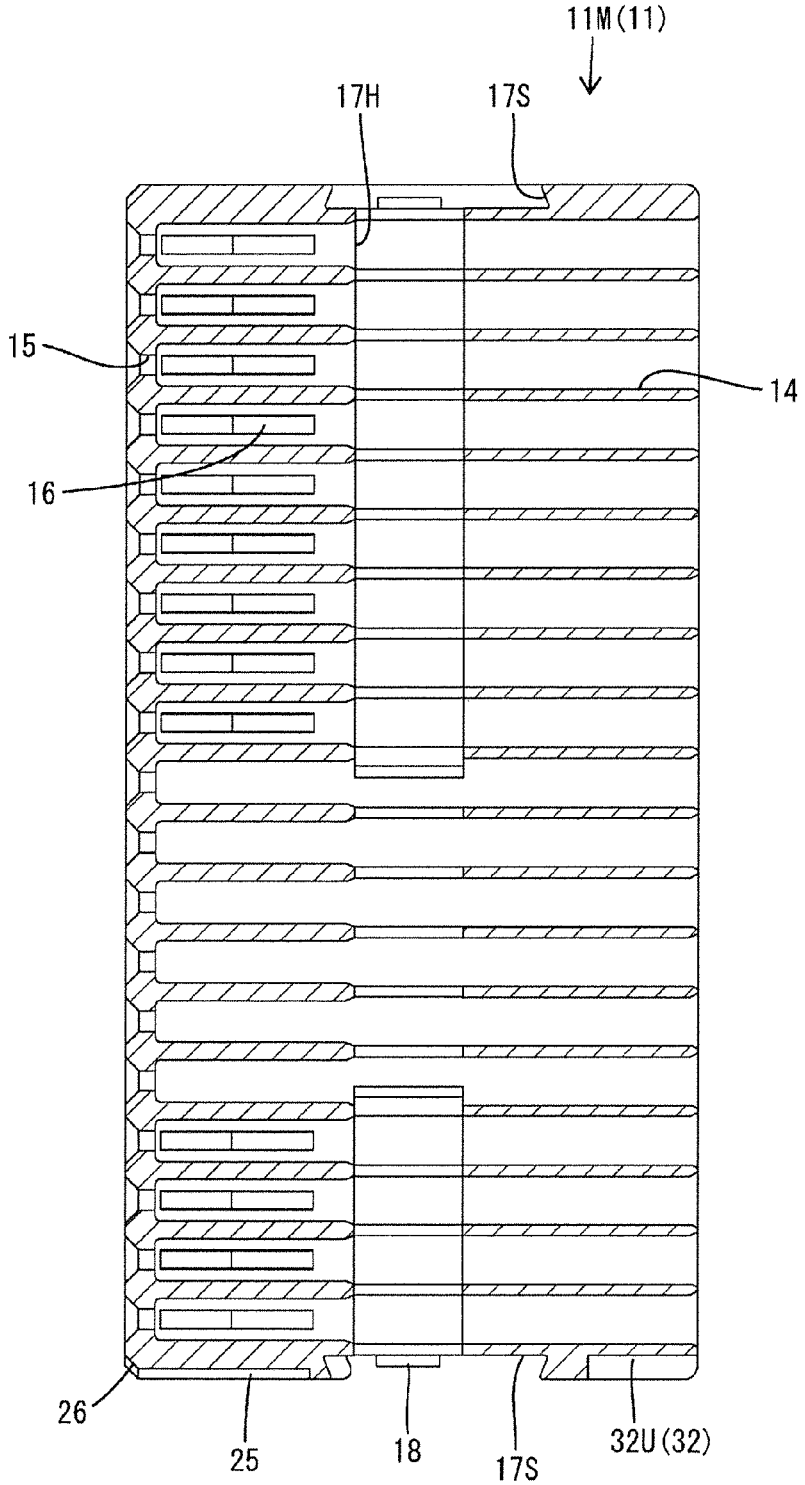
FIG. 4 is a section, corresponding to a cross-section at a position A-A of FIG. 3, showing the main housing.
Figure 5:
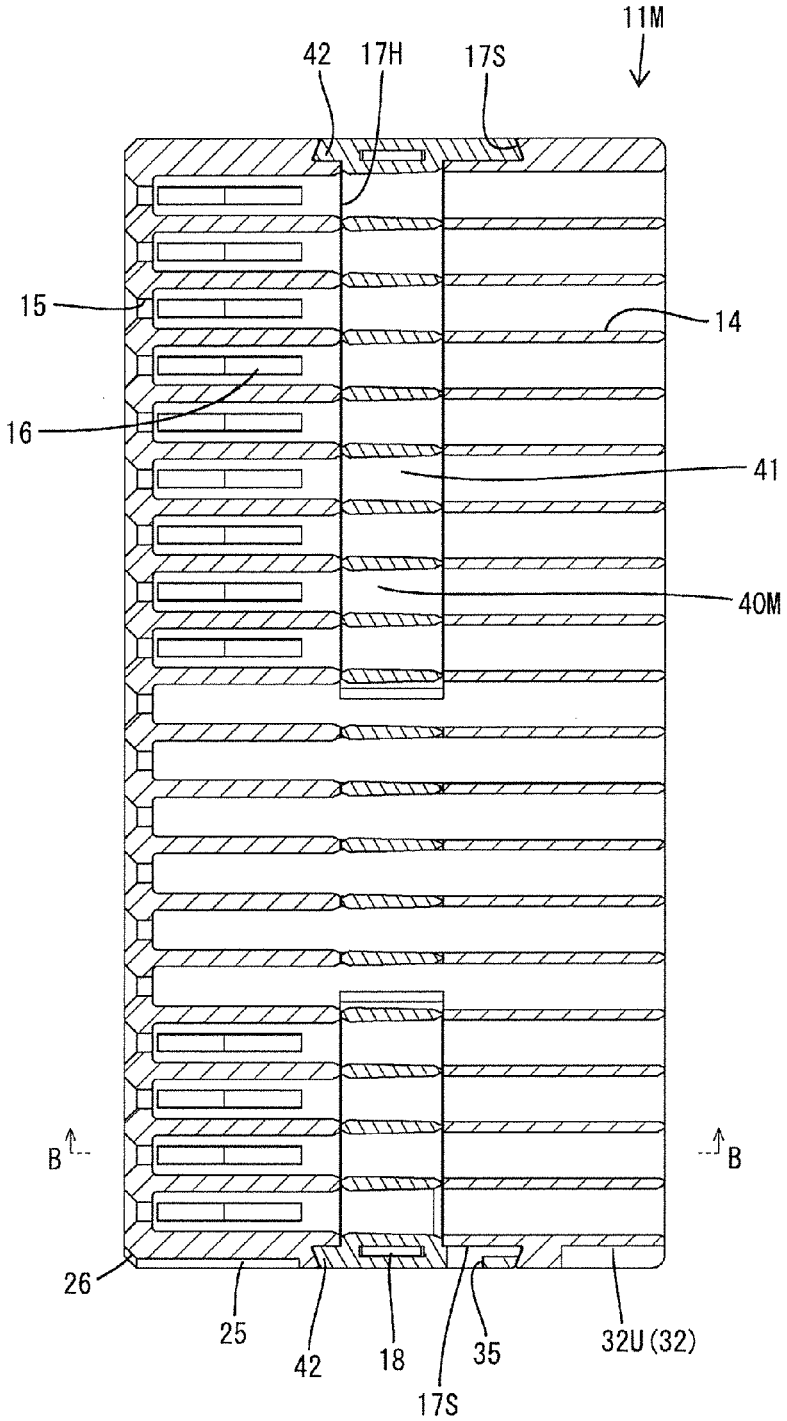
FIG. 5 is a section, corresponding to the cross-section at the position A-A of FIG. 3, showing the main housing in the state where the main retainer is assembled.

The coupling recesses 32 are provided on one of the left and right side surfaces of the main housing 11M (surface closer to the lock arm 21 and to be coupled to the sub-housing 11S). The coupling recesses 32 include a front coupling recess 32M in the form of a groove extending rearward from the front surface of the main housing 11M and open forward and laterally as shown in FIG. 3. The front coupling recess 32M is substantially in a center in a vertical direction (height direction) of the main housing 11M.

Figure 12:
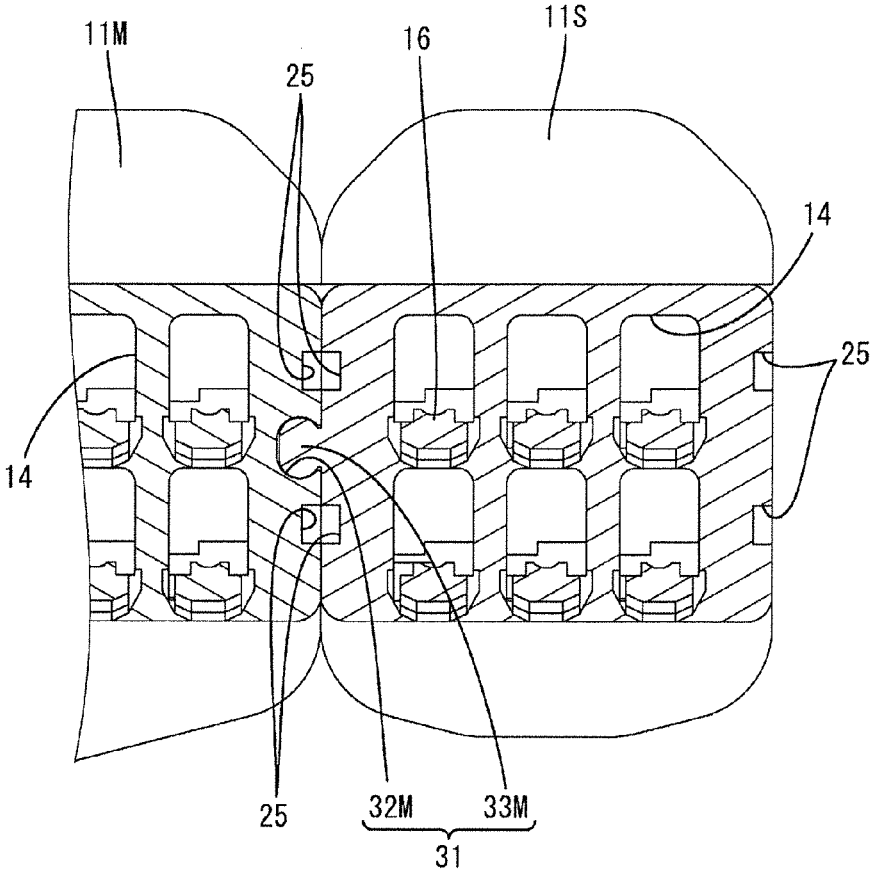
FIG. 12 is a partial enlarged section showing front coupling structures of the main housing and the first sub-housing.

The front coupling recess 32M has an oval cross-sectional shape slightly longer in the vertical direction when viewed from the front, as shown in FIG. 12. The upper and lower surfaces of the front coupling recess 32M are arcuate curved surfaces and a surface of the front coupling recess 32M on a back side in a recessed direction is substantially parallel to the vertical direction. A vertical dimension of a substantially center of the front coupling recess 32M in the recessed direction is larger than a vertical dimension at an open end.

Figure 13:
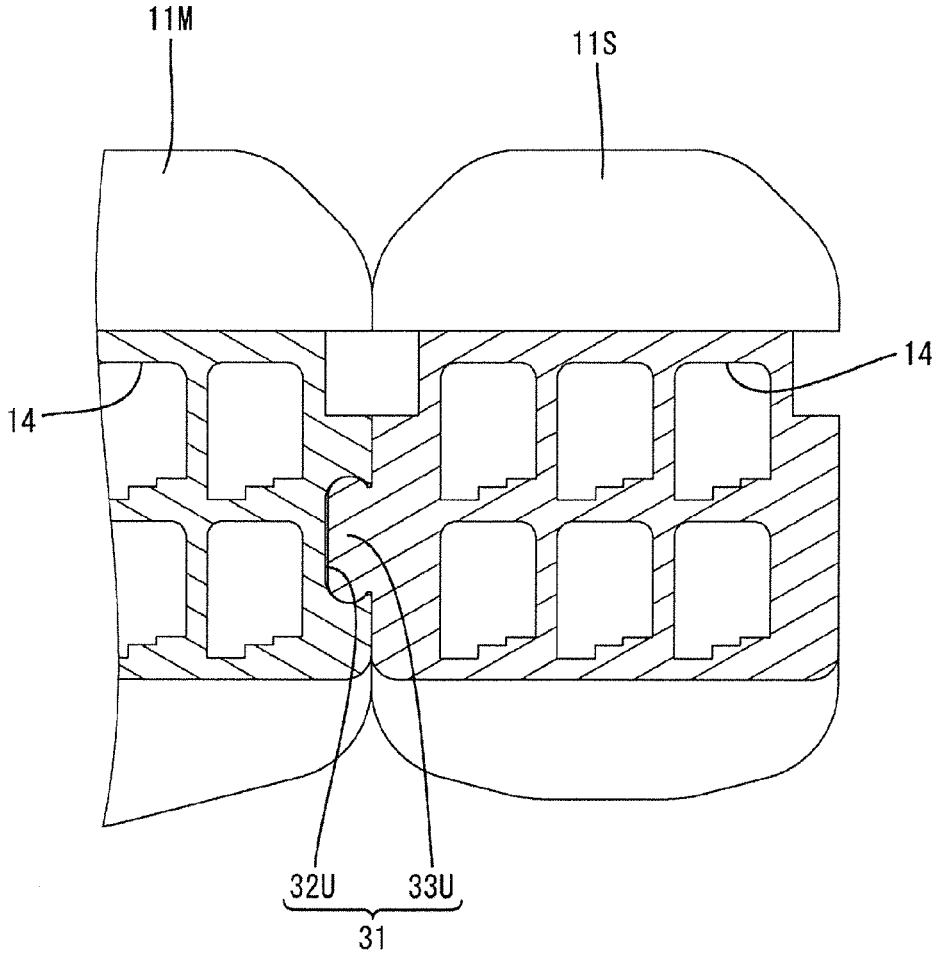
FIG. 13 is a partial enlarged section showing rear coupling structures of the main housing and the first sub-housing.

The coupling recesses 32 further include a rear coupling recess 32U in the form of a groove extending forward from the rear surface of the main housing 11M and open rearward and laterally, as shown in FIG. 3. The rear coupling recess 32U has an oval cross-sectional shape slightly longer in the vertical direction when viewed from behind as shown in FIG. 13. Note that the vertical dimensions of the rear coupling recess 32U is larger than the front coupling recess 32M in the vertical direction and the recessed dimensions thereof are equal.

Figure 7:
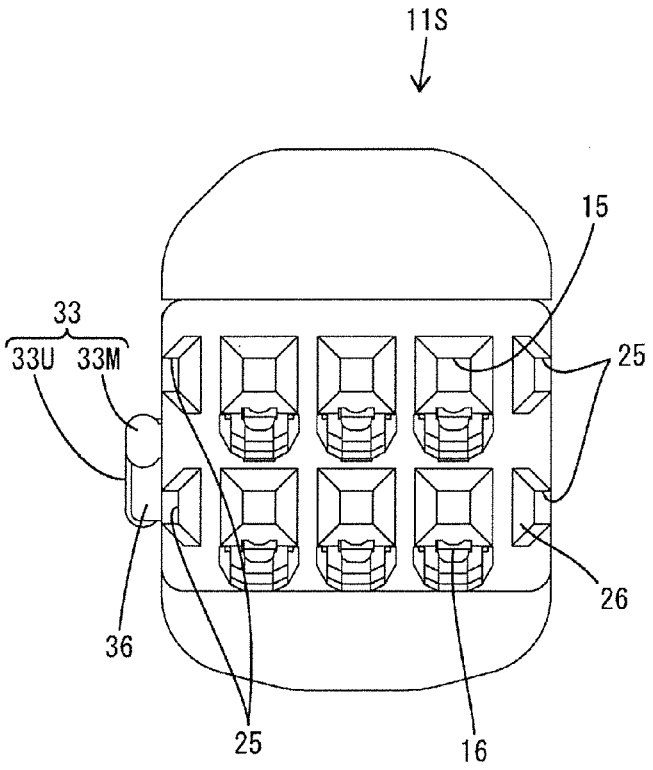
FIG. 7 is a front view showing a first sub-housing.

As shown in FIG. 7, the coupling projections 33 are provided on the coupling surface to the main housing 11M side surfaces of the sub-housing 11S. Each coupling projection 33 has substantially the same oval cross-sectional shape long in the vertical direction as the corresponding coupling recess 32 and the upper and lower surfaces thereof are arcuate curved surfaces, as shown in FIGS. 12 and 13.

Figure 8:
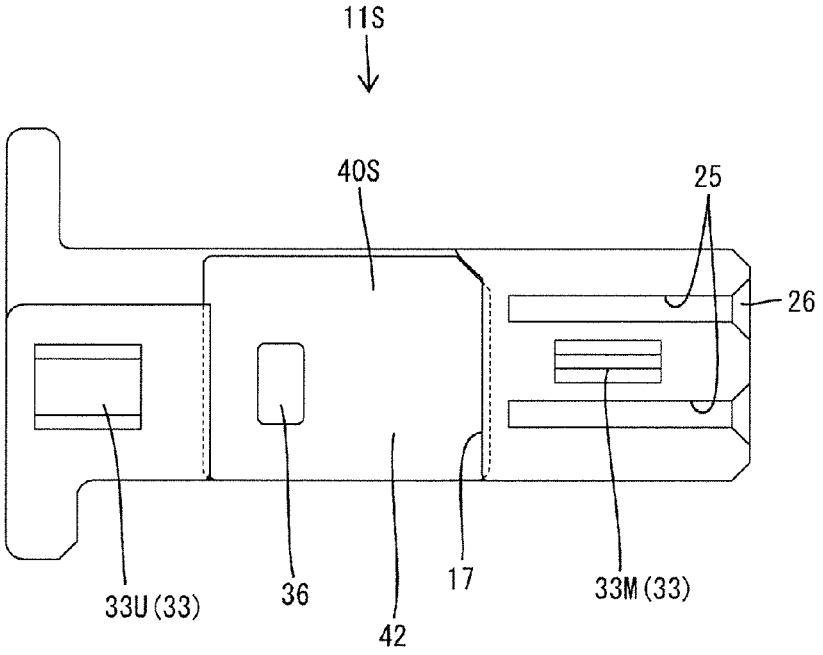
FIG. 8 is a side view showing the first sub-housing.
Figure 9:
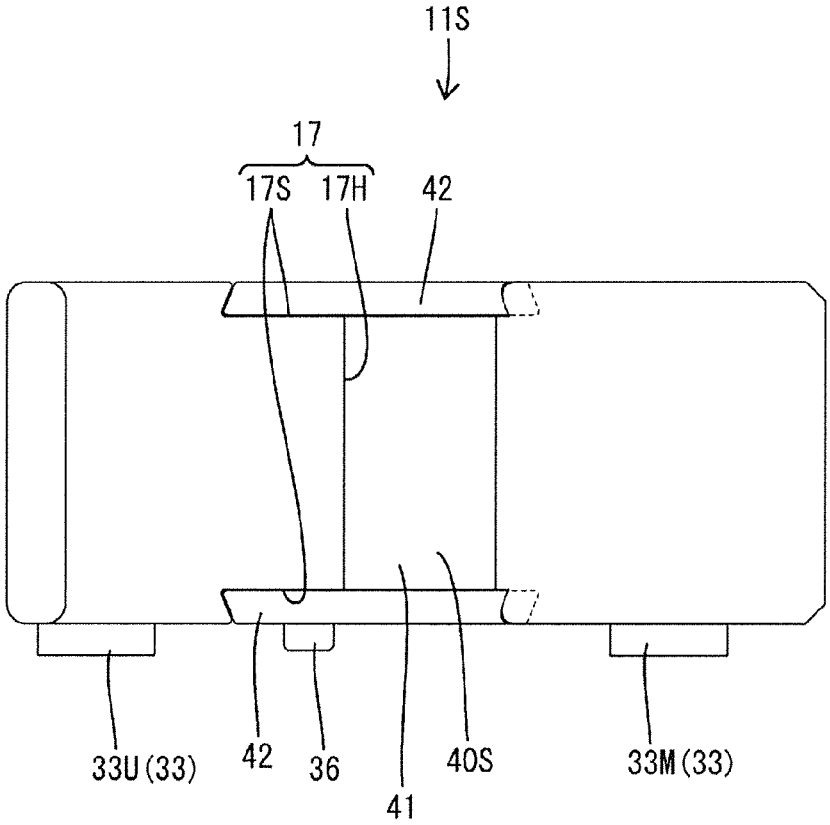
FIG. 9 is a bottom view showing the first sub-housing.

The coupling projections 33 include a front coupling projection 33M provided at a height position corresponding to the front coupling recess 32M, as shown in FIG. 8. Further, the front coupling projection 33M is arranged substantially in a center in the front-rear direction on a part of the side surface of the sub-housing 11S before the retainer 40. A dimension in the front-rear direction of the front coupling projection 33M is shorter than that of the front coupling recess 32M. The front end of the front coupling projection 33M is located behind the front surface of the sub-housing 11S and the rear end of the front coupling projection 33M is arranged substantially at the same position as that of the front coupling recess 32M.

The coupling projections 33 further include a rear coupling projection 33U at a height position corresponding to the rear coupling recess 32U. A dimension in the front-rear direction of the rear coupling projection 33U is shorter than that of the rear coupling recess 32U. The front end of the rear coupling projection 33U is arranged substantially at the same position as that of the rear coupling recess 32U and the rear end of the rear coupling projection 33U is located before the rear surface of the sub-housing 11S.

Figure 14:
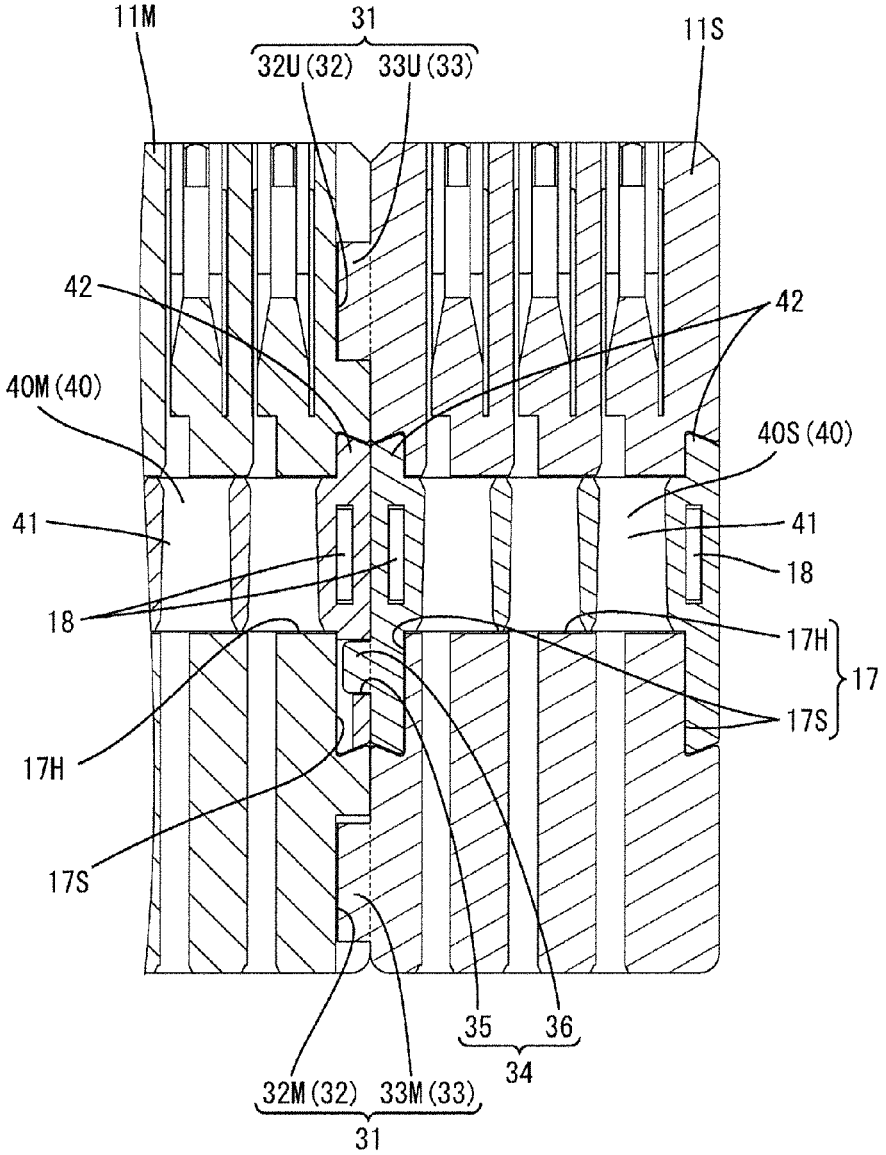
FIG. 14 is a section, corresponding to a cross-section at a position D-D of FIG. 10, showing the coupling structures and positioning structures of the main housing and the first sub-housing.
Figure 15:
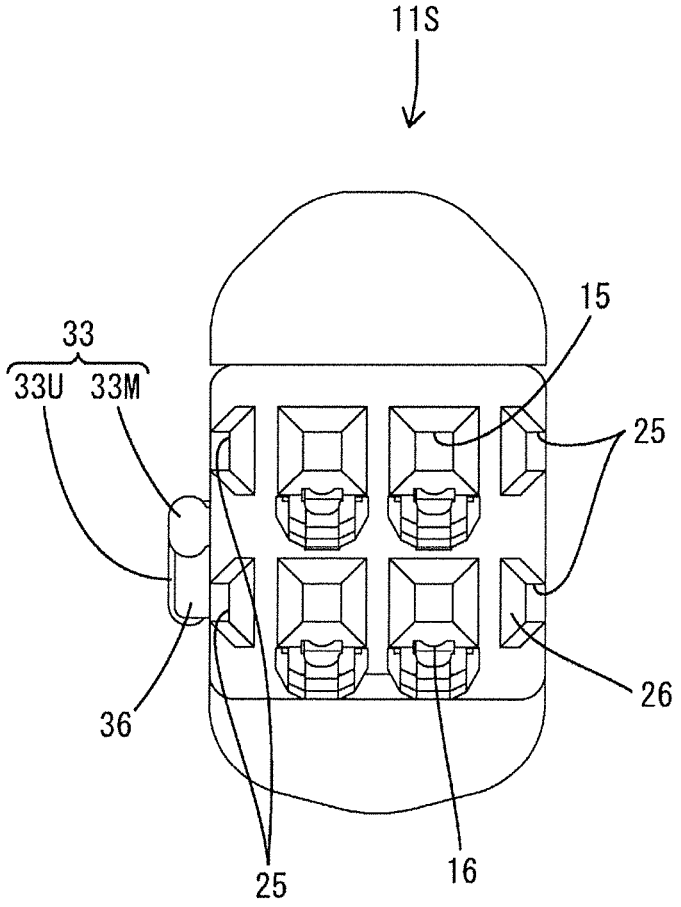
FIG. 15 is a front view showing a second sub-housing.

As shown in FIG. 14, positioning structures 34 are provided on side surfaces of the retainers 40 for effecting positioning by being fit to each other when the main housing 11M and the sub-housing 11S are united. The positioning structures 34 are configured to effect positioning by fitting a positioning projection 36 projecting on the side surface of a sub-retainer 40S to be mounted into the sub-housing 11S into a positioning recess 35 formed by recessing the side surface of a main retainer 40M to be mounted into the main housing 11M. The positioning structures 34 are long in the vertical direction, as shown in FIGS. 3 and 8.

As shown in FIG. 14, the positioning recess 35 penetrates through the side wall 42 of the main retainer 40M in the lateral direction. The positioning recess 35 is formed on a part of the side wall 42 of the main retainer 40M projecting farther rearward than the retainer body 41 (part to be overlapped with an outer side of the side surface of the main housing 11M). The side surface of the main housing 11M is on a back side of the positioning recess 35 when the main retainer 40M is assembled with the main housing 11M,.

As shown in FIG. 3, the positioning recess 35 has a long and narrow rectangular shape in the vertical direction and is closed over the entire periphery. The positioning recess 35 is arranged at a height position equal to the rear coupling recess 32U when the main retainer 40M is assembled with the main housing 11M.

The positioning projection 36 is shaped to conform to the positioning recess 35 and is a flat block having a rectangular shape long in the vertical direction when viewed laterally, as shown in FIG. 8. With the positioning recess 35 and the positioning projection 36 fit, only a slight clearance is formed in the vertical direction almost without any clearance in the front-rear direction. Note that a vertical dimension of the positioning projection 36 is equal to that of the rear coupling projection 33U provided on the sub-housing 11S.

Tab insertion grooves 25 are formed on a coupling part of the united main housing 11M and sub-housing 11S, and receive tab-like terminals 52 when connected to the mating connector 50. The tab insertion grooves 25 are formed in one surface (coupling surface) of the left and right side surfaces of the main housing 11M and both left and right side surfaces of the sub-housing 11S (see FIGS. 2 and 7).

As shown in FIG. 3, the tab insertion grooves 25 open forward and laterally and are identically shaped in any of the housings 11. The tab insertion grooves 25 extend rearward from the front surface (front end) of each housing 11 and have at least a length equal to or longer than that of the tab-like terminals 52. The rear ends of the tab insertion grooves 25 are located before the retainer mounting portion 17. Further, a front end part of each tab insertion groove 25 is formed with a guiding portion 26 inclined to guide the tab-like terminal 52. Note that the front coupling structure 31 is formed substantially in a center between the upper and lower tab insertion grooves 25.

Upper and lower tab insertion grooves 25 are formed in the side surface of each housing 11. As shown in FIG. 7, the upper and lower tab insertion grooves 25 are arranged side by side with the tab insertion holes 15 of the cavities 14 in the upper stage and the tab insertion holes 15 of the cavities 14 in the lower stages substantially at the same heights as these tab insertion holes.

Figure 10:
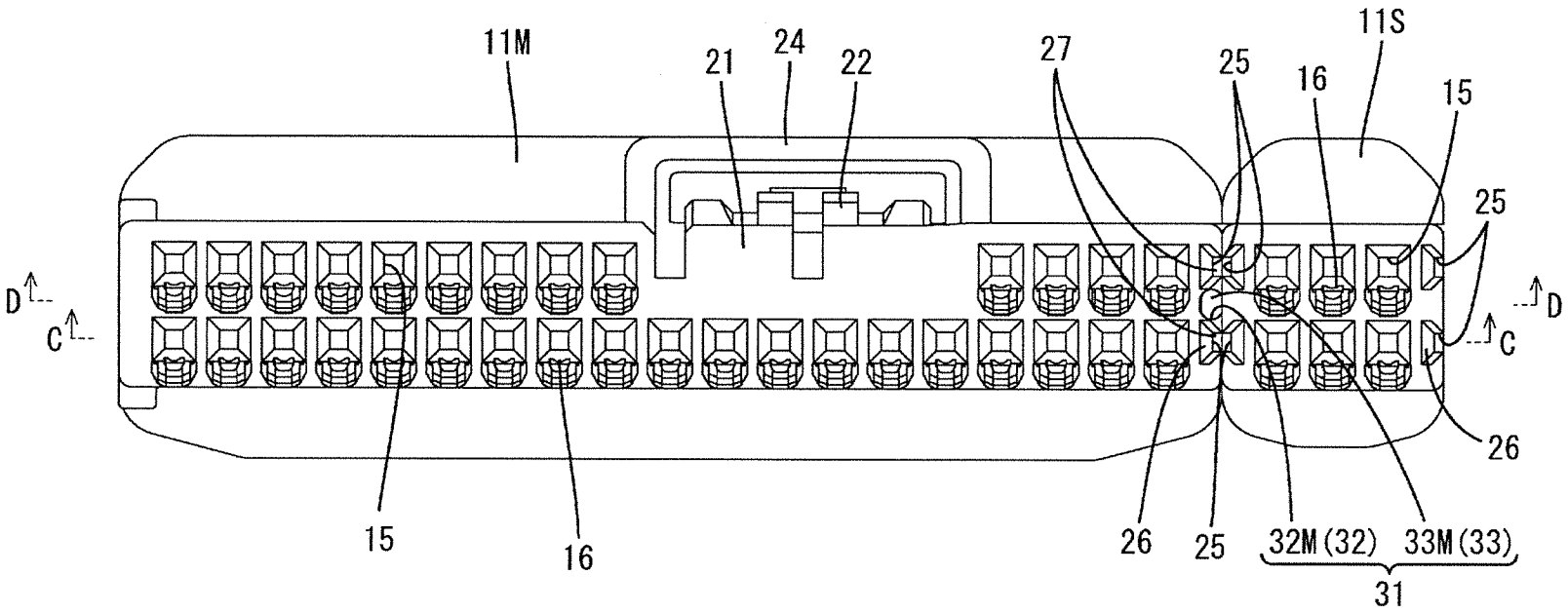
FIG. 10 is a front view showing a state where the first sub-housing is united with the main housing.

With the main housing 11M and the sub-housing 11S united, tab accommodating portions 27 having the same shape as the tab insertion holes 15 and extending rearward are formed by the tab insertion grooves 25 provided on the main housing 11M and the tab insertion grooves 25 provided on the sub-housing 11S, as shown in FIG. 10. The tab accommodating portion 27 is in the form of a long and narrow hole having a substantially square cross-section and enabling the insertion of only one tab-like terminal 52.

Next, an example of a connecting operation of the connector 10 and the mating connector 50 is described.

First, the terminal fittings 12 are accommodated into each of the main housing 11M and the sub-housing 11S. The retainer 40 is set at the partial locking position in each housing 11 and the terminal fittings 12 are inserted into the cavities 14 from behind. When the terminal fitting 12 reaches the proper insertion position, the locking lance 16 locks the terminal fitting 12 so that the terminal fitting 12 is held in a retained state. After the insertion of all the terminal fittings 12 is finished, the retainer 40 is pushed to the full locking position and the retaining portions 43 are locked to the rear ends of the terminal bodies 13 of the terminal fittings 12 so that the terminal fittings 12 are held collectively in the retained state. In this way, each of the main housing 11M and the sub-housing 115 is connected to an end of a predetermined circuit.

Subsequently, the connector 10 is connected. At this time, depending on a vehicle type, grade or the like, only the main housing 11M is connected to the mating connector 50 or the main housing 11M united with any one of the first, second and third sub-housings 11S is connected to the mating connector 50.

In the case of uniting the sub-housing 11S with the main housing 11M, the side surfaces of these housings are opposed and pressed against each other. Then, the coupling projections 33 are pressed against openings of the coupling recesses 32 and fit to the back sides of the coupling recesses 32 while the upper and lower curved surfaces thereof are pushing and widening the openings of the coupling recesses 32 so that the curved surfaces of the coupling projections 33 and those of the coupling recesses 32 are fit almost without any clearance and the openings of the coupling recesses 32 are closed. In this way, the curved surfaces of the coupling projections 33 and those of the coupling recesses 32 come into contact to fix the main housing 11M and the sub-housing 11S in the vertical direction and also in the lateral direction by closing the openings of the coupling recesses 32. Further, as shown in FIG. 14, the rear end of the front coupling projection 33M is in contact with the rear end of the front coupling recess 32M and the front end of the rear coupling projection 33U is in contact with the front end of the rear coupling recess 32U to fix the main housing 11M and the sub-housing 11S in the front-rear direction. By coupling the coupling structures 31 to each other in this way, the main housing 11M and the sub-housing 11S are held united.

Further, simultaneously, the positioning projection 36 is fit into the positioning recess 35 and the main retainer 40M and the sub-retainer 40S are positioned in the front-rear direction and the vertical direction.

Figure 16:
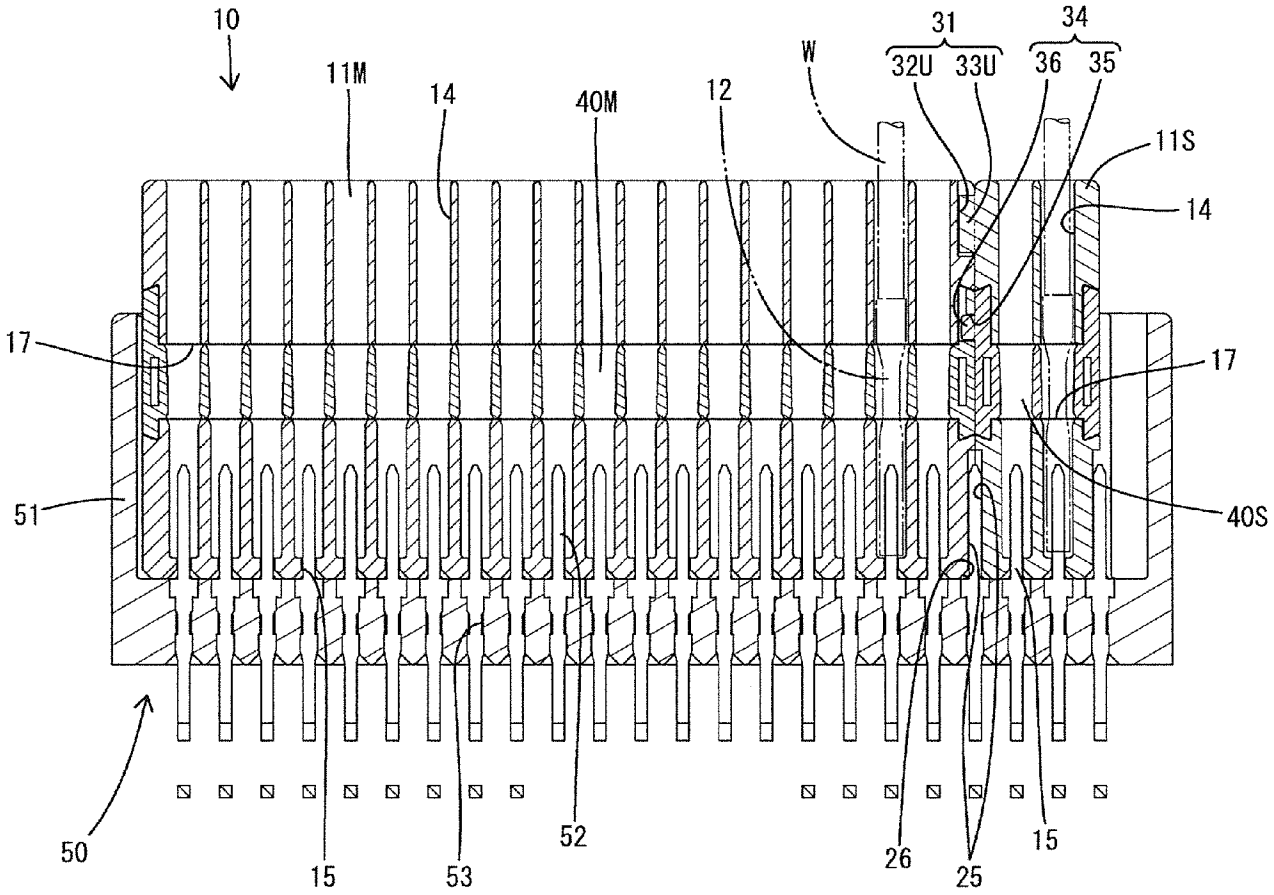
FIG. 16 is a section showing a state where the united main housing and second sub-housing are connected to the mating connector.
Figure 17:
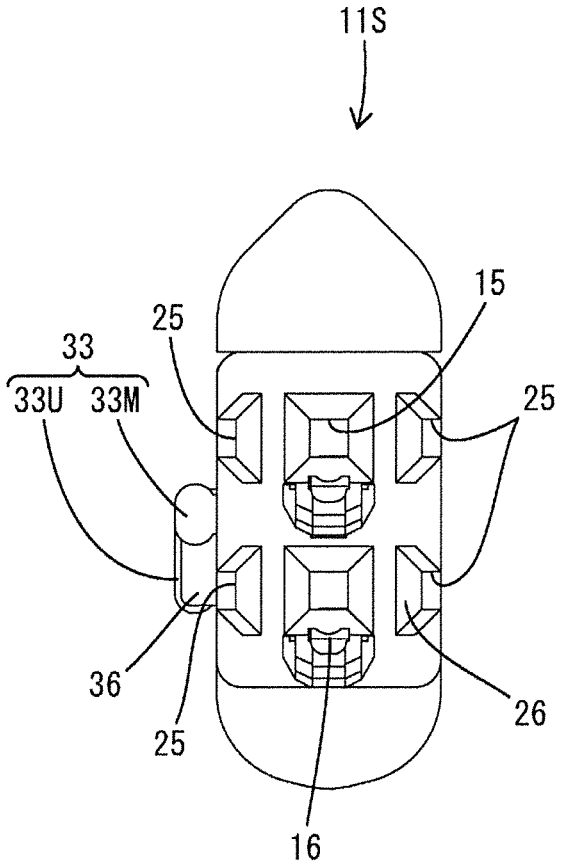
FIG. 17 is a front view showing a third sub-housing.
Figure 18:
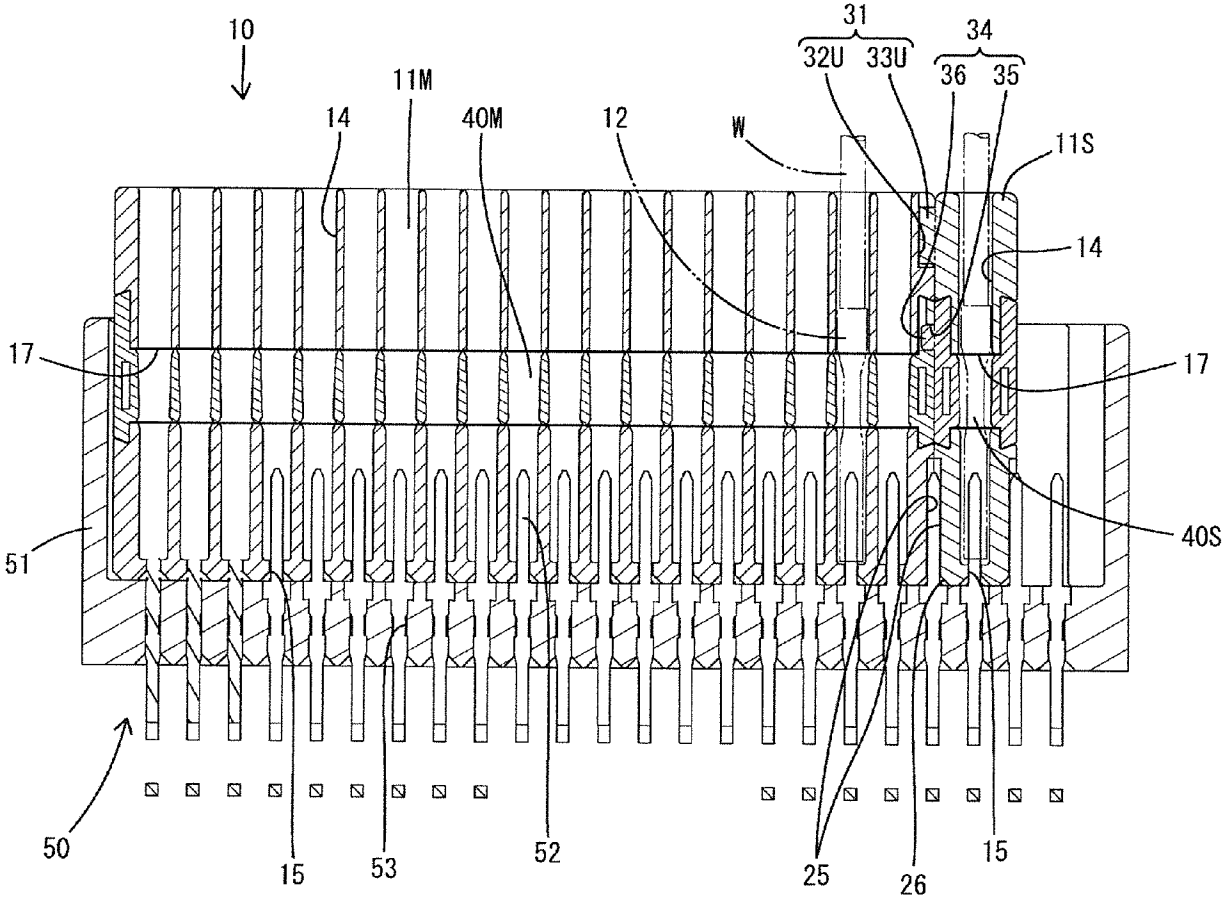
FIG. 18 is a section showing a state where the united main housing and third sub-housing are connected to the mating connector.

The connector 10 composed of the single main housing 11M or formed by uniting the sub-housing 11S with the main housing 11M is pushed toward the receptacle 51 of the mating connector 50 fixed on the print board P. Then, the lock protrusion 22 of the lock arm 21 is locked to the lock receiving portion 54 of the receptacle 51 after moving over the lock receiving portion 54 to lock the connectors 10, 50 in a properly connected state. On the other hand, the tab-like terminals 52 enter the terminal body portions 13 of the terminal fittings 12 held in the housing 11 to be connected electrically, and the tab-like terminals 52 not corresponding to the cavities 14 are inserted respectively into the tab insertion grooves 25 formed in the side surfaces of the main housing 11M and the sub-housing 11S, as shown in FIG. 11, 16 or 18.

In this way, the connecting operation of the connector 10 and the mating connector 50 is completed.

Next, functions and effects of the embodiment configured as described above are described.

In the connector 10 of this embodiment, the housings 11 for accommodating the terminal fittings 12 electrically connectable to the tab-like terminals 52 include the main housing 11M having the locking structure for locking the mating connector 50 and the plurality of types of sub-housings 11S selectively unitable with the main housing 11M and having different numbers of poles. The main housing 11M and the sub-housing 11S are united by coupling the side surfaces to each other, and the tab insertion grooves 25 into which the tab-like terminals 52 are inserted at the time of connection to the mating connector 50 are formed in the coupling part of the united housings 11.

According to this configuration, the number of poles of the connector 10 can be changed by uniting the sub-housing 11S appropriately selected from the plurality of types of sub-housings 11S with the main housing 11M. Further, since the locking structure is provided on the main housing 11M instead of the sub-housings 11S to be appropriately changed, the locking structure of the mating connector 50 need not be changed. Furthermore, the tab-like terminals 52 are inserted into the tab insertion grooves 25. Thus, changes of the mating connector 50 such as the omission of the tab-like terminals 52 need not be made. Thus, a change in the number of poles of the connector 10 can be dealt with without structurally changing the mating connector 50.

Further, the retainer 40 for locking and retaining the accommodated terminal fittings 12 is mounted into the housing 11 and the positioning structures 34 for effecting positioning by being fit to each other when the housings 11 are united are provided on the side surfaces of the retainers 40. According to this configuration, the retainers 40 can be positioned in the housings 11 in the united state.

Further, the coupling structures 31 provided on the side surface of the housings 11 are coupled to each other by being pushed in facing directions of the side surfaces of the housings 11 to be united, and the positioning structures 34 are configured such that the positioning projection 36 is fit into the positioning recess 35 closed over the entire periphery. According to this configuration, the retainers 40 can be positioned on four sides in the housings 11 in the united condition.

The invention is not limited to the above described and illustrated embodiment. For example, the following embodiments are also included in the technical scope of the present invention.

Although the tab insertion grooves 25 are formed in both the side surface of the main housing 11M and the side surface of the sub-housing 11S in the above embodiment, there is no limitation to this and the tab insertion grooves may be formed in only one of the side surfaces and the tab-like terminals may be inserted thereinto.

Although the coupling recesses 32 are formed in the side surface of the main housing 11M and the coupling projections 33 are formed on the side surface of the sub-housing 11S in the above embodiment, there is no limitation to this and coupling recesses may be formed on the main housing side and coupling recesses may be formed on the sub-housing side or a coupling recess and a coupling projection may be provided in a mixed manner on the side surface of each housing.

Although the coupling structures 31 are provided on the front and rear sides of the housing 11 in the above embodiment, there is no limitation to this and positions where coupling structures are provided can be changed.

Although the main housing 11M is fit into the part of the mating connector 50 near one side without any clearance in the above embodiment, there is no limitation to this. For example, a main housing may be fit into a central part of a mating connector and connection spaces into which sub-housings are to be fit may be formed at opposite sides of the main housing in a lateral direction, i.e. the sub-housings may be united with both sides of the main housing.

Although the main housing 11M and the sub-housing 11S are united in the lateral direction in the above embodiment, there is no limitation to this and a main housing and a sub-housing may be united in the vertical direction. For example, the main housing may be fit into an upper end side of a mating connector and the sub-housing may be fit into a connection space formed on a lower side of the mating connector.

Although one main housing 11M and one sub-housing 11S are connected in the above embodiment, there is no limitation to this and another sub-housing may be united with the sub-housing united with the main housing.

Although the positioning recesses 35 are penetrating in the above embodiment, there is no limitation to this and positioning recesses may be bottomed recesses.

Although the positioning recesses 35 are openings closed over the entire periphery in the above embodiment, there is no limitation to this and positioning recesses may not be closed over the entire periphery and, for example, may be in the form of notches open toward one side.

Although the tab accommodating portion 27 composed of a pair of tab insertion grooves 25 has the same shape as the tab insertion hole 15 in the above embodiment, there is no limitation to this. For example, a tab accommodating portion may be larger than a tab insertion hole or may have a substantially circular shape.

Although the mating connector 50 is illustrated to be a board connector in the above embodiment, there is no limitation to this and the present invention can be applied when a mating connector is one of various connectors with tab-like terminals.

Although the coupling structures 31 are coupled to each other by being pushed in the facing directions of the side surfaces of the housings 11 to be united in the above embodiment, there is no limitation to this. For example, coupling structures may be composed of dovetail groove and projection to be coupled by sliding housings to be united in the vertical direction or front-rear direction.

Although three types of sub-housings 11S are illustrated in the above embodiment, there is no limitation to this and there may be two, four or more types of sub-housings.

Although only one type of the main housing 11M is available in the above embodiment, there is no limitation to this and a plurality of types of main housings having different number of poles may be provided and a sub-housing may be selectively united with each main housing.

Although the mating connector 50 is a connector with 40 poles in the above embodiment, there is no limitation to this and the present invention can be applied regardless of how many poles there are in a mating connector or whether the tab-like terminals are arranged only in one stage, three or more stages and the arrangements of cavities of housings and the like can be appropriately changed according to the form of the mating connector.

LIST OF REFERENCE SIGNS

10 . . . connector
11 . . . housing
11M . . . main housing
11S . . . sub-housing
12 . . . terminal fitting
21 . . . lock arm (locking structure)
25 . . . tab insertion groove
31 . . . coupling structure
34 . . . positioning structure
35 . . . positioning recess
36 . . . positioning projection
40 . . . retainer
50 . . . mating connector
52 . . . tab-like terminal

The invention claimed is:

1. A connector assembly comprising:

a mating connector having a receptacle with a lock receiving portion and tabs projecting into the receptacle; and a connector configured to be inserted into the receptacle of the mating connector along a connecting direction, the connector including a main housing and at least one sub-housing, the main housing being formed with a lock that is engageable with the lock receiving portion on the receptacle of the mating connector, the main housing and the at least one sub-housing being formed with outer side surfaces that are united with one another to form the connector, the main housing and the at least one sub-housing being formed with cavities and terminal fittings being inserted respectively into the cavities, the cavities being disposed and configured so that each terminal fitting in each cavity mates with one of the tabs of the mating connector when the main housing and the at least one sub-housing united therewith is inserted into the receptacle of the mating connector, the outer side surfaces of the main housing and the at least one sub-housing that are united with one another being formed respectively with insertion grooves that register with one another when the main housing and the at least one sub-housing are united to form tab accommodating portions, each of the tab accommodating portions on the connector being disposed to receive one of the tabs of the mating connector.

2. The connector assembly of claim 1 wherein the connector is a first connector, the main housing is a first main housing and the at least one sub-housing is at least one first sub-housing and the tab accommodating portions are first tab accommodating portions, the connector assembly further comprising a second connector having a second main housing and at least one second sub-housing, the second main housing being formed with a lock that is engageable with the lock receiving portion on the receptacle of the mating connector, the second main housing and the at least one second sub-housing being formed with side surfaces that are united with one another to form the second connector, the second main housing and the at least one second sub-housing being formed with cavities and terminal fittings being inserted respectively into the cavities, the cavities being disposed and configured so that each terminal fitting in each cavity mates with one of the tabs of the mating connector when the second main housing and the at least one second sub-housing united therewith is inserted into the receptacle of the mating connector, the side surfaces of the second main housing and the at least one second sub-housing that are united with one another being formed respectively with insertion grooves that register with one another when the second main housing and the at least one second sub-housing are united to form second tab accommodating portions, each of the second tab accommodating portions on the second connector being disposed to receive one of the tabs of the mating connector that is spaced from the tab received by the first tab accommodating portion, whereby the first or second connector that is inserted into the receptacle is selected in accordance with the tabs that are not to be connected to terminal fittings in a particular application of the connector assembly.

3. The connector assembly of claim 1, further comprising:

at least one coupling recess formed in the side surface of the main housing; and at least one coupling projection formed on a side surface of the at least one sub-housing and configured to be inserted into the at least one coupling recess of the main housing to unite the main housing and the at least one sub-housing.

4. The connector assembly of claim 1, wherein the insertion grooves are formed at front edges of the main housing and the at least one sub-housing, the insertion grooves being forwardly and laterally open.

* * * * *